US009957134B2

(12) United States Patent
Hodge

(10) Patent No.: US 9,957,134 B2
(45) Date of Patent: May 1, 2018

(54) ROLLER GUIDE FOR ELEVATORS

(71) Applicant: Colin Hodge, Ellicott City, MD (US)

(72) Inventor: Colin Hodge, Ellicott City, MD (US)

( * ) Notice: Subject to any disclaimer, the term of this patent is extended or adjusted under 35 U.S.C. 154(b) by 0 days. days.

(21) Appl. No.: 15/614,749

(22) Filed: Jun. 6, 2017

(65) Prior Publication Data

US 2017/0362057 A1 Dec. 21, 2017

Related U.S. Application Data

(60) Provisional application No. 62/351,047, filed on Jun. 16, 2016.

(51) Int. Cl.
*B66B 7/04* (2006.01)

(52) U.S. Cl.
CPC ..... *B66B 7/046* (2013.01); *B66B 7/048* (2013.01)

(58) Field of Classification Search
CPC ..... B66B 7/046; B66B 7/048
See application file for complete search history.

(56) References Cited

U.S. PATENT DOCUMENTS 1,713,165 A * 5/1929 Bridge ..... B66B 7/046 16/91
1,854,976 A * 4/1932 Brady ..... B66B 7/046 187/406
3,099,334 A 7/1963 Tucker, Jr.
3,329,240 A * 7/1967 Harwood ..... B66B 7/046 187/410
3,856,117 A * 12/1974 Solymos ..... B66B 7/046 187/406
5,632,358 A * 5/1997 Maeda ..... B66B 7/046 187/410
6,032,764 A 3/2000 Ferrisi et al.
6,050,370 A * 4/2000 Jung ..... B66B 7/046 187/409
6,345,698 B1 * 2/2002 Ravishankar ..... B66B 7/046 187/409
7,562,749 B2 7/2009 Race, Sr. et al.
8,251,186 B2 * 8/2012 Webster ..... B66B 7/04 187/401
9,567,189 B2 2/2017 Laughton
9,650,228 B2 * 5/2017 Sakuma ..... B66B 7/046
9,731,937 B2 * 8/2017 Steiner ..... B66B 7/046
2007/0000732 A1 1/2007 Kulak et al.
2014/0158473 A1 6/2014 Arai et al.
(Continued)

*Primary Examiner* — Michael A Riegelman
(74) *Attorney, Agent, or Firm* — Winston & Strawn LLP

(57) ABSTRACT

An elevator roller guide assembly that provides enhanced ride comfort. The assembly includes a chassis, a stop plate mounted to the chassis, a face wheel enclosure that at least partially encloses the face wheel and is connected to a plurality of leaf springs, and a pair of side wheel enclosures connected to the face wheel enclosure by the plurality of leaf springs. The side wheel enclosures each support a side wheel in a fixed relation to the other side wheel. The side wheel enclosures are operably connected to the stop plate by a pair of vertical plates. A multi-axis damper extends from the stop plate to engage the face wheel enclosure and dampen oscillation of the wheel enclosures during operation. A set of delta diameter wheels across all four guides reduces coincident flat spots to improve ride quality. Also, a wheel force gauge is integrated with the face wheel enclosure.

18 Claims, 7 Drawing Sheets

(56) References Cited

U.S. PATENT DOCUMENTS

| | | | | |
|---|---|---|---|---|
| 2015/0232301 | A1* | 8/2015 | Sakuma | B66B 7/046<br>187/410 |
| 2015/0298938 | A1* | 10/2015 | Fargo | B66B 7/046<br>187/401 |
| 2015/0321885 | A1* | 11/2015 | Laughton | B66B 7/048<br>187/410 |

* cited by examiner

ROLLER GUIDE FOR ELEVATORS

RELATED APPLICATIONS

This application claims the benefit of U.S. provisional application no. 62/351,047 filed Jun. 16, 2016, the entire content of which is expressly incorporated herein by reference thereto.

FIELD OF THE INVENTION

This invention relates to an elevator roller guide assembly designed to guide an elevator car along a guide rail, and more specifically to improvements in roller guide structure and functionality.

BACKGROUND OF THE INVENTION

A general elevator device includes a hoist mechanism arranged to move an elevator car in upward and downward directions along an elevator shaft. Guides are arranged to stably maintain the orientation and positioning of the elevator car within the elevator shaft during operation. For example, the guides may include a pair of guide rails disposed within the elevator shaft along the upward and downward directions, and roller guide assemblies which correspond to the respective guide rails, and which are disposed, respectively, at positions above and below the elevator car. Each of the roller guide assemblies includes a plurality of rollers arranged to be rolled on a plurality of guide surfaces of the guide rails.

Since it is exceedingly difficult to mount and maintain guide rails in perfect alignment and maintain the conveying device in perfect balance, the results are high noise levels, swaying, poor ride quality, and passenger discomfort. The configuration of prior guide roller assemblies also contributed to accelerated wear and maintenance difficulties. The present invention seeks to solve these problems by improving the roller guide assembly arrangement.

SUMMARY OF THE INVENTION

The present invention discloses an elevator roller guide assembly that provides enhanced ride comfort using roller guide wheels engaging an elevator guide rail in an improved assembly. In accordance with one embodiment of this invention, there is provided an assembly including a chassis, a stop plate mounted to the chassis, a face wheel enclosure, supporting a face wheel, wherein the face wheel enclosure at least partially encloses the face wheel and is connected to a plurality of leaf springs attached by an upper portion and a lower portion of the face wheel enclosure, a pair of side wheel enclosures connected to the face wheel enclosure by the plurality of leaf springs, wherein the side wheel enclosures each support a side wheel in a fixed relation to the other side wheel and wherein the side wheel enclosures are operably connected to the stop plate by a pair of vertical plates, a multi-axis damper extending from the stop plate to engage the face wheel enclosure and dampen oscillation of the face and side wheels by damping the face wheel enclosure during operation of the assembly; and a wheel force gauge integrated with the face wheel enclosure, indicating face and side wheel loading.

Other objects, advantages, and novel features of the invention will become more apparent when taken in conjunction with the accompanying drawings.

DETAILED DESCRIPTION

Figure 1:
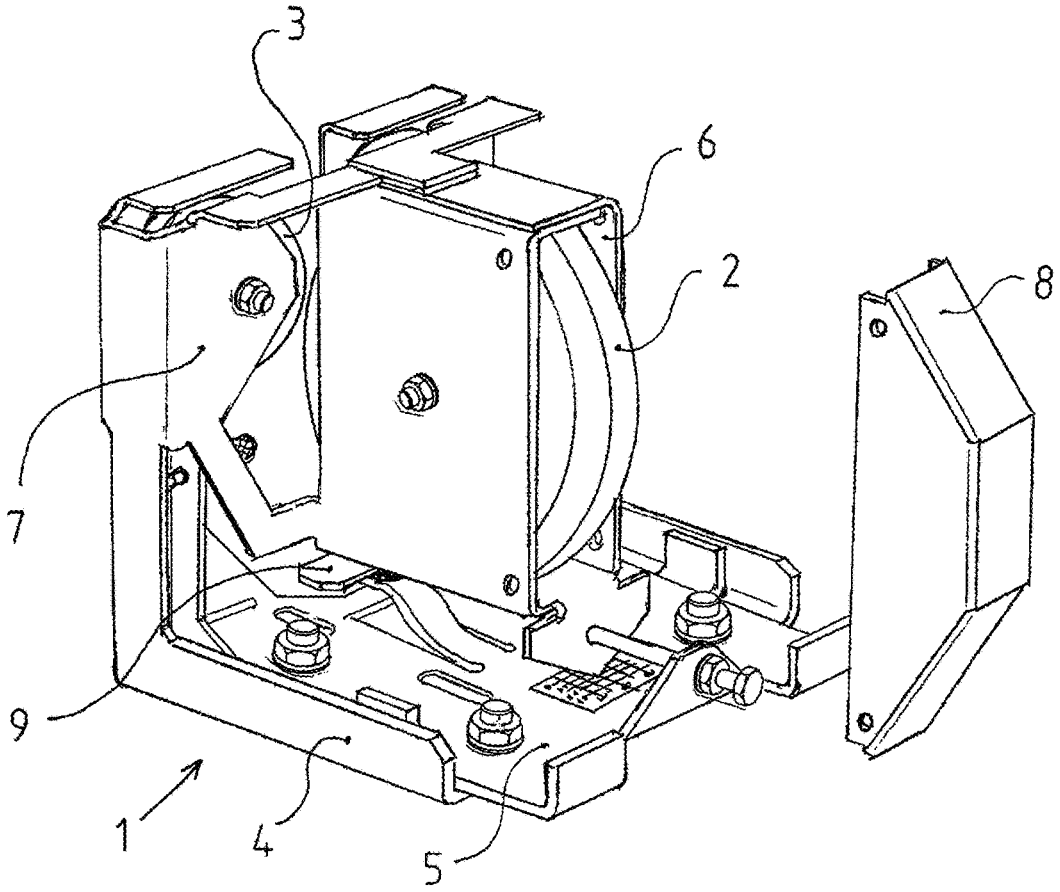
FIG. 1 is a perspective view of a guide roller assembly according to an embodiment of the present invention.
Figure 2:
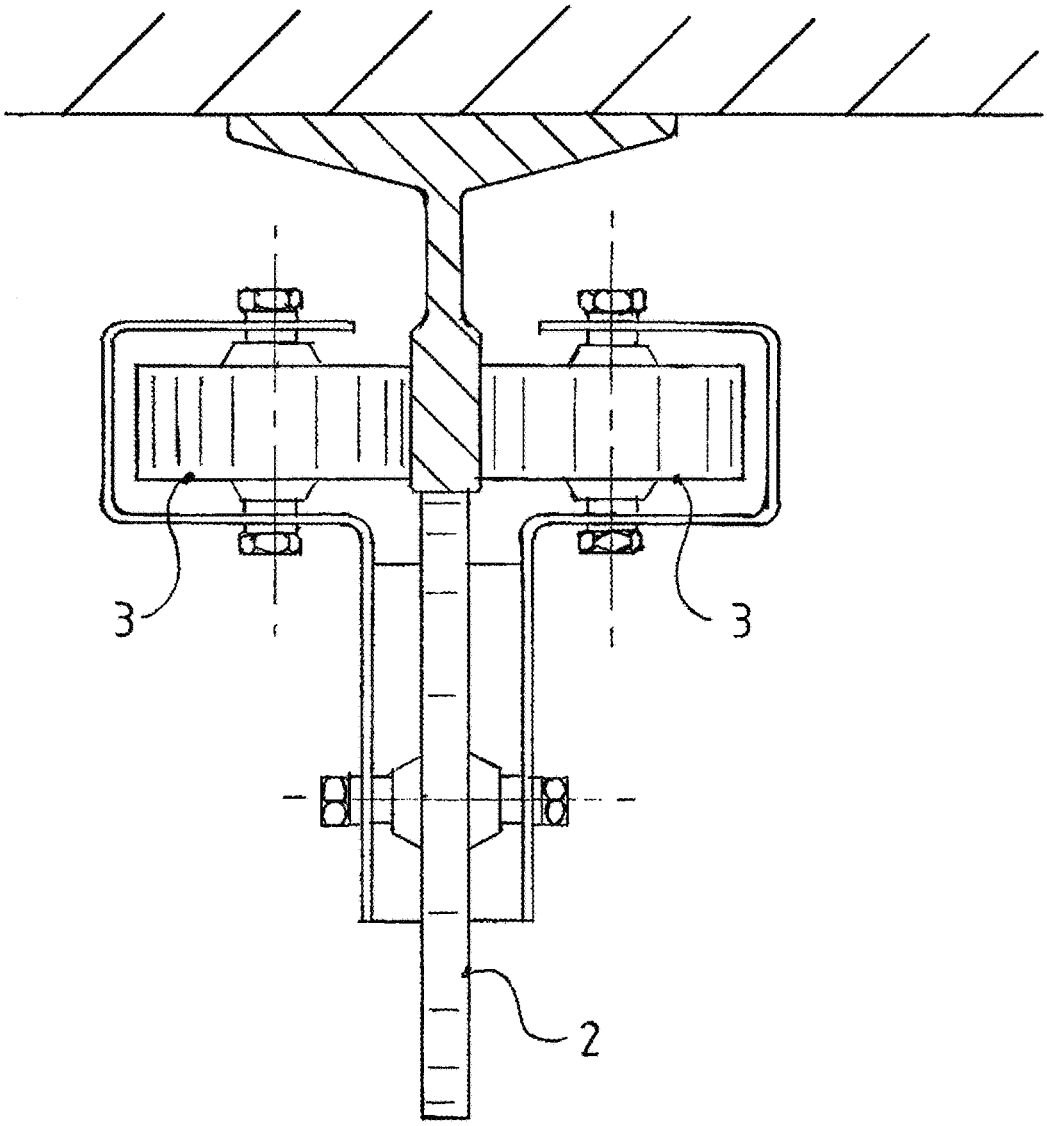
FIG. 2 is a plan view of a guide roller assembly according to an embodiment of the present invention.
Figure 3:
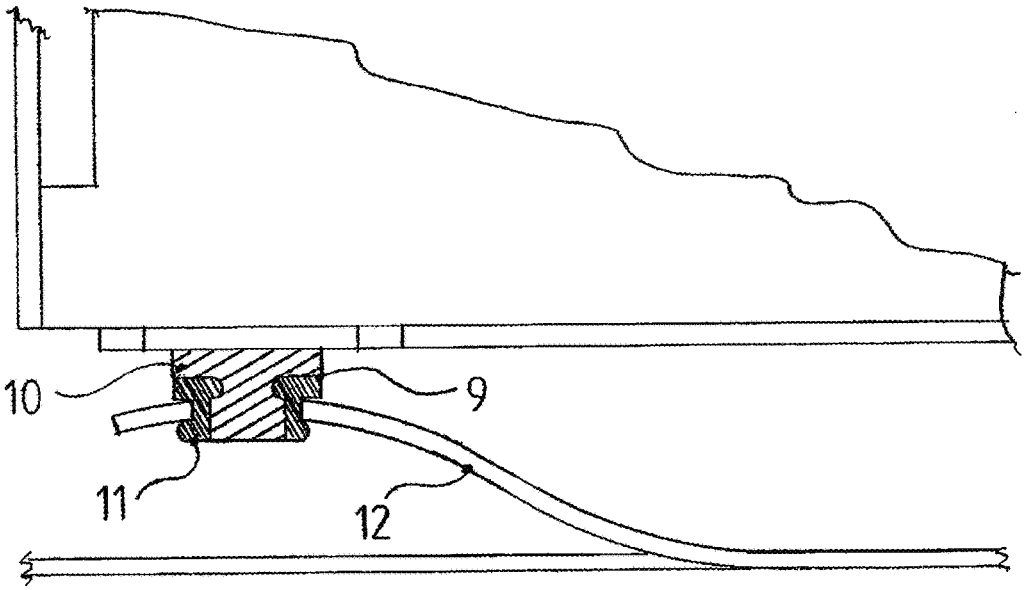
FIG. 3 is an elevation view of a portion of a guide roller assembly according to an embodiment of the present invention.

The roller guide system of the present invention preferably includes a set of four elevator roller guide assemblies, designed to operate together to stabilize an elevator car in transit along an elevator shaft by engaging longitudinally extending elevator guide rails located along the elevator shaft. This guide system is designed to be used not only on the car and its rails, but also on the counterweight and its rails. As a result, a base interface is also provided that accommodates both bolt mounting patterns with the same guide. This feature is a simplification for installation and a cost benefit in production and supply of such roller guide assemblies.

The elevator roller guide assembly is generally the first assembly of a plurality of elevator roller guide assemblies mounted on an elevator. Preferably, the diameter of the face wheel of the first assembly is different from the diameter of the face wheel of another one of the plurality of roller guide assemblies; and the diameter of the side wheels of the first assembly are different from each other as well as the diameter of the side wheels of another one of the plurality of roller guide assemblies. In a particular embodiment, the elevator roller guide assembly contains delta diameter wheels wherein the diameters of the face wheels of the plurality of roller guide assemblies differ by as no more than +0.5" and preferably by +0.01" to 0.02" the diameter of each other, and wherein the diameters of the side wheels of the plurality of roller guide assemblies differ by no more than +0.5" and preferably by +0.01" to 0.02" the diameter of each other.

Each roller guide assembly 1 includes a large diameter face wheel 2 preferably aligned in position by two smaller diameter side wheels 3, the side wheels being disposed facing each other at a fixed spacing so as to straddle and engage the sides of an elevator guide rail. The face wheel 2 of each assembly 1 is self-aligning with the elevator guide rail edge, and has a larger diameter than the side wheels 3 that engage the elevator guide rail sides. The fixed spacing of the side wheels 3 reduces face wheel 2 tire wear by preventing scrubbing, along with rutting and grooving due to running on rail edges, caused by side wheel movement during operation.

The roller guide assembly 1 includes a chassis 4 and a stop plate 5 preferably formed from sheet metal material. The stop plate 5 is mounted on the chassis 4 and supports the structure for the wheels. Wheel diameters and widths are preferably maximized, within the parameters reasonably allowable by roller guide footprint requirements, to increase tread contract areas while lowering surface pressure and resultant wear. The face wheel 2 may be between 3" and 12" in diameter and is preferably approximately 6.6" in diameter, while the side wheels 3 may also be between 3" and 12" in diameter. The side wheel tire treads are preferably approximately 1" to 2" wide or wider if desired. This is at least 100% greater than conventional side wheel widths that are approximately 0.5". The face wheel tire treads are preferably approximately 0.6" to 2" or wider, which is greater than conventional side wheel width of approximately 0.5" by at least 20%. Wheel size and width contribute to a smooth ride.

The ratio between the diameter size of the face wheel and side wheels is generally between 1:1 and 4:1. In the most preferred embodiment, the ratio is 2:1 with the face wheel 2 being between 6" and 7" and approximately 6.6" in diameter, and the side wheels 3 being between 3" and 441 and approximately 3.3" in diameter.

The roller assembly prevents the creation of coincident flat spots on the side wheels and face wheel though the utilization of differential diameter wheels. Flat spots on the wheels, caused by either wheel scrubbing or by prolonged inactivity, can result in vibration and poor ride quality when coincident flat spots engage the elevator guide rail simultaneously as the wheels rotate. The wheels are each of slightly different diameter, in the order of nor more than 0.5" and preferably by a difference of approximately 0.02" to 0.04" in diameter, thereby differentiating the angular rotation of each wheel in relation to the linear distance travelled by the elevator to prevent coincident flat spots that would cause bumps or vibrations during operation.

Figure 4:
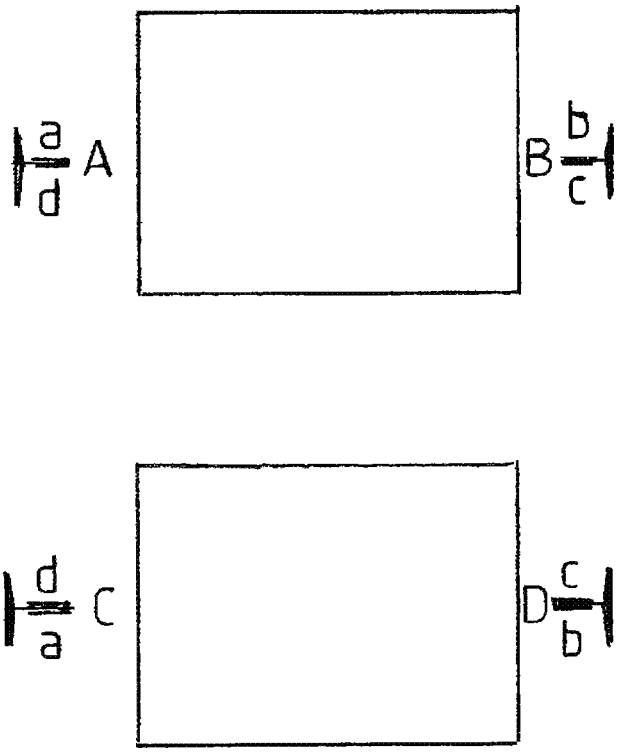
FIG. 4 is an illustration of wheel configurations of an embodiment of the present invention.
Figure 5:
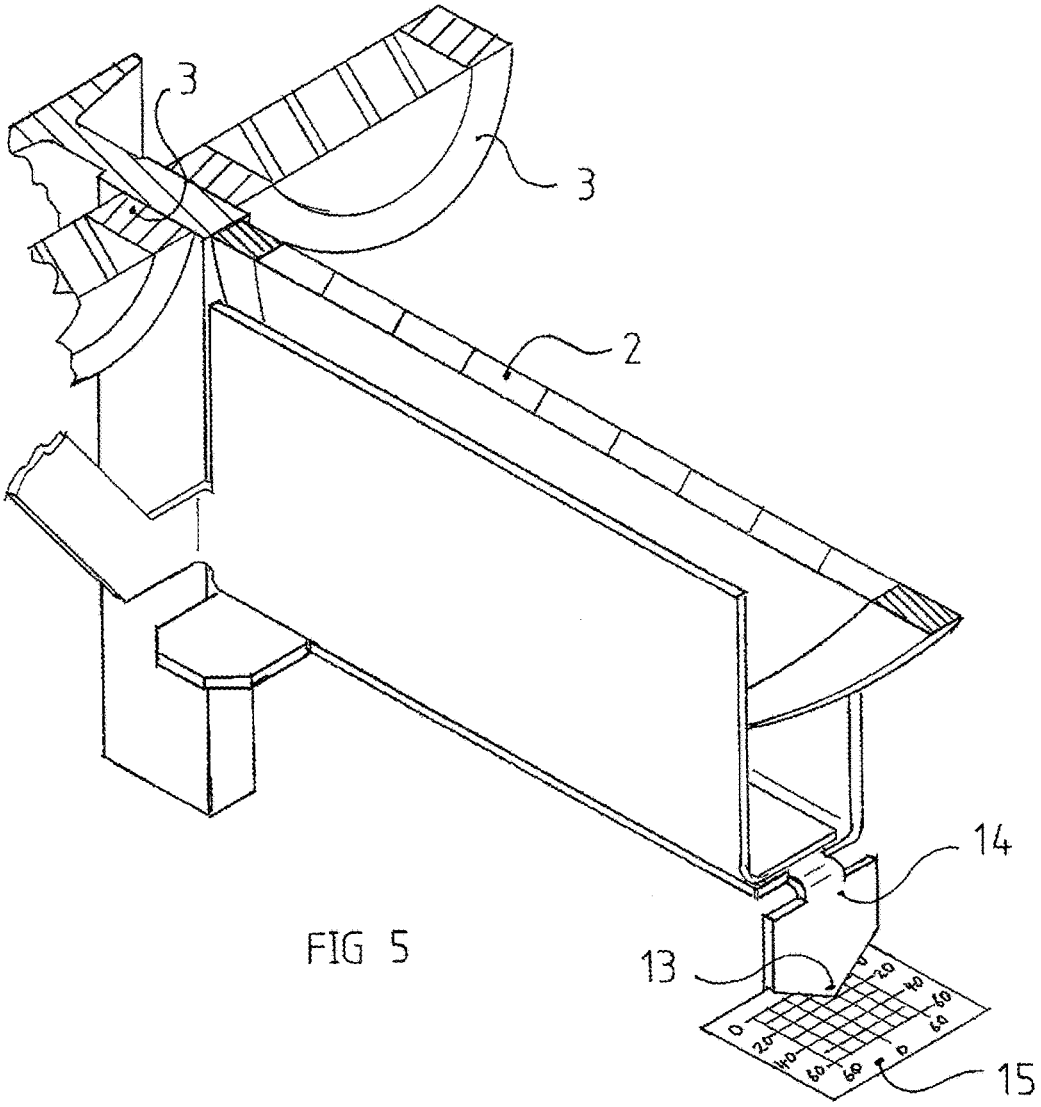
FIG. 5 is a perspective view of a portion of a guide roller assembly according to an embodiment of the present invention.

As shown in FIG. 4, each roller guide assembly in a set can have a particular combination of wheel diameter arrangements chosen to reduce the likelihood of coincident flat spots under expected loading conditions. For example, a first assembly can have the combination of face wheel 2 diameter "A" in combination with side wheels 3 diameters "a" and "d;" a second assembly can have the combination of face wheel 2 diameter "B" in combination with side wheels 3 diameters "b" and "c," and so on. The incidence of flat spots may also be reduced by the use of material with high durometer hardness for the guide assembly wheels. The durometer of the wheels may be between 80 A to 100 A, and is preferably approximately 90 A, as compared with typical wheel hardness of 70 A. Variations in the hardness of the wheel material used is allowable as may be required by actual working and environmental conditions.

Accordingly, the invention provides a no-flat tire system, comprising several of the following: delta diameter wheels across all four roller guides having different diameters, tires having a durometer hardness of between 80 A to 100 A, a multi-axis damper, a wheel force gage, a complete wheel enclosure, or a self-aligning face wheel.

The face wheel is preferably supported by a face wheel enclosure 6, which is a support structure that is formed from sheet metal and at least partially encloses the sides of the wheel. The face wheel enclosure 6 is supported by a plurality of laterally extending plate supports attached to the upper portion and the lower portion of the enclosure. The axle of the face wheel is mounted between opposing sides of the support structure and allows for free rotation of the face wheel. The laterally extending plates at the top of the face wheel support structure act as a structural support, but also can twist so as to act as torsion bars to allow for longitudinal movement of the face wheel support structure as it rotates about the laterally extending plates in response to forces acting on the face wheel. The lower portion of the face wheel support structure is supported by diagonal leaf springs that likewise allow for the longitudinal movement of the face wheel support structure. The side wheels 3 are supported by side wheel support structures 7 mounted on vertical leaf springs. The vertical leaf springs also provide an inward force to the side wheels as they engage the elevator guide rails.

A tread contact cover 8 may be integrated with the face wheel support structure 6 to enclose and protect the face wheel 2. The tread cover 8 may consist of folded stainless steel sheet metal structure enclosing the face wheel 2. Alternatively, tread contact cover 8 may be formed from other metals, plastic or other suitable materials. The tread contact cover 8 improves the durability and safety of the assembly, blocking dirt and debris, hands, fingers, clothing and feet, from having access to the wheel in the normal fashion of a physical barrier.

Movement of the face wheel enclosure 6 is dampened through the use of a multi-axis damper 9 pressing on the underside of the face wheel enclosure. The damper consists of a button shaped pad 10 comprising composite friction material designed for use with stainless steel, riding on an elastomeric mount 11 e.g., a urethane mount, positioned on a leaf spring 12. Other elastomeric materials mounts can instead be used if desired. The leaf spring 12 extends from the bottom side of stop plate 5 to press the damper pad 10 against the underside of face wheel enclosure 6.

An integrated wheel force gauge 13 measures and displays to the installer the applied force of the wheels against the rail, and allows the installer to apply correct loading. The gauge is comprised of an indicator arm 14 rigidly attached to and extending down from the face wheel support structure, along with scaled markings 15 placed below the indicator arm and calibrated to indicate the amount of force being applied against the elevator guide rail by the face wheel 2 and the side wheels 3. The gauge presents an immediate and accurate indication of the amount of load being applied to the wheels, allowing for the application of task appropriate loads to be used, thereby preventing flat spots and poor ride quality.

Another feature of the elevator roller guide assembly of the invention is that it provides a mounting system of holes that allows bolt patterns of either the car or counter weights to be accommodated by the roller guide. This feature is shown in FIGS. 6-8 and results in a simplification for installation as well as a significant cost benefit in production and supply of such roller guide assemblies as the same assemblies can easily be installed on either the car or counterweights.

Figure 7:
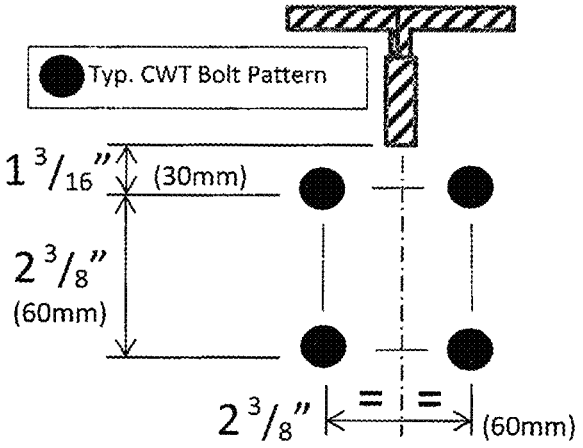
FIGS. 6 and 7 illustrate the location of mounting holes for conventional car and counterweight installation of conventional roller guides.
Figure 6:
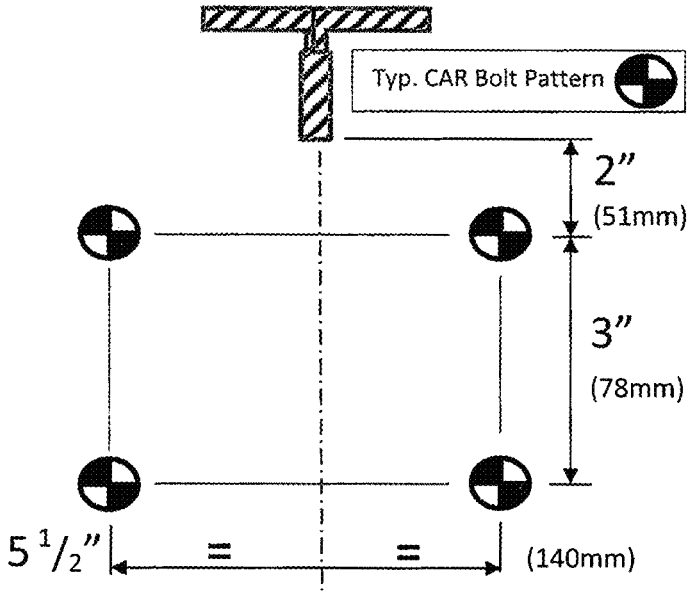
Figure 8:
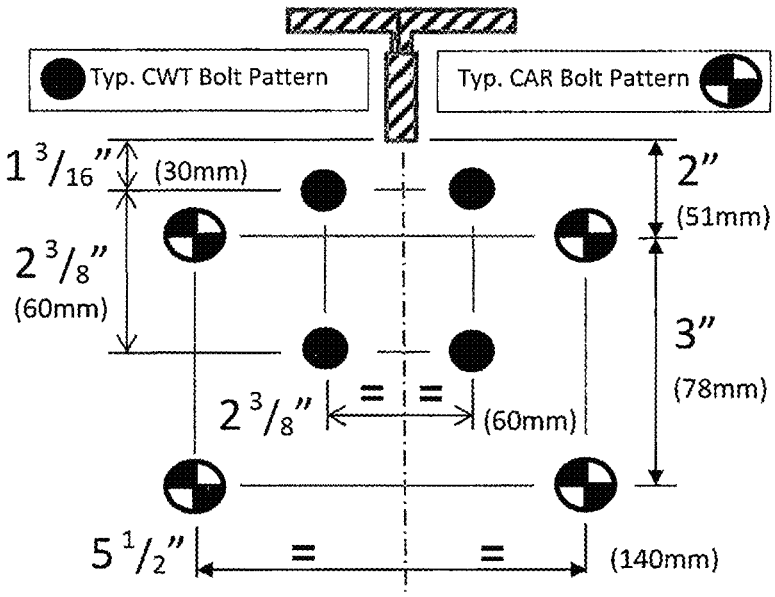
FIG. 8 illustrates the location of mounting holes for the car or counterweight roller assemblies of the present invention.

FIG. 6 illustrate the mounting holes for a conventional roller guide that is mounted on an elevator car, while FIG. 7 illustrates the mounting holes for a conventional roller guide that is mounted on the counterweights. The present invention avoids the need for separate car and counterweight assemblies but providing both mounting holes on the base plate so that the present roller guides can be mounted on either one. This avoids the needs for separate inventory for each installation and instead allows the present assemblies to be mounted universally.

The terms "about" or "approximately" as used herein are used as ordinarily understood by a skilled artisan, and include a tolerance that can be as large as ±20% but usually no more than ±5% to ±10%.

In the foregoing specification, the invention has been described with reference to specific embodiments thereof. It will, however, be evident that various modifications and changes are made thereto without departing from the spirit and scope of the invention. For example, the reader is to understand that the specific arrangements described herein are merely illustrative, and the invention can be performed using different but obvious arrangements, or with the addition of conventional components or features that are generally known in the art. Accordingly, the invention is not to be restricted to the preferred embodiments disclosed and instead are encompassed by the appended claims as those claims would be understood by a skilled artisan.

What is claimed is:

1. An elevator roller guide assembly comprising:

a chassis;

a stop plate mounted on the chassis;

a face wheel enclosure, supporting a face wheel, wherein the face wheel enclosure at least partially encloses the face wheel and is connected to a plurality of leaf springs attached by an upper portion and a lower portion of the face wheel enclosure;

a pair of side wheel enclosures connected to the face wheel enclosure by the plurality of leaf springs, wherein the side wheel enclosures each support a side wheel in a fixed relation to the other side wheel and wherein the side wheel enclosures are operably connected to the stop plate by a pair of vertical plates;

a multi-axis damper extending from the stop plate to engage the face wheel enclosure and dampen oscillation of the face and side wheels by damping the face wheel enclosure during operation of the assembly; and one or more of the following:

a wheel force gauge integrated with the face wheel enclosure, indicating face and side wheel loading; or each wheel has a slightly different diameter on the order of no more than 0.5" from the other wheels; or a mounting system of holes that accommodates the bolt patterns of cars or counterweights.

2. The elevator roller guide assembly of claim 1, wherein the elevator roller guide assembly is the first assembly of a plurality of elevator roller guide assemblies mounted on an elevator car or counterweight; and the diameter of the face wheel of the first assembly is different from the diameter of the face wheel of another one of the plurality of roller guide assemblies; and the diameter of the side wheels of the first assembly are different from each other as well as the diameter of the side wheels of another one of the plurality of roller guide assemblies.

3. The elevator roller guide assembly of claim 2, containing delta diameter wheels wherein the diameters of the face wheels of the plurality of roller guide assemblies differ by between 0.01" and 0.5" the diameter of each other, and wherein the diameters of the side wheels of the plurality of roller guide assemblies differ by between 0.01" and 0.5" the diameter of each other.

4. The elevator roller guide assembly of claim 2, containing delta diameter wheels wherein the diameters of the face wheels of the plurality of roller guide assemblies differ by between 0.01" and 0.02" the diameter of each other, and wherein the diameters of the side wheels of the plurality of roller guide assemblies differ by between 0.01" and 0.02" the diameter of each other.

5. The elevator roller guide assembly of claim 1, wherein the face wheel is between 3" to 12" in diameter and has a tire that is at least 0.6" up to 2" wide.

6. The elevator roller guide assembly of claim 1, wherein the side wheels are between 3" to 12" in diameter and have tires that are between 1" to 2" wide.

7. The elevator roller guide assembly of claim 6, wherein the face wheel has a diameter of between about 6 and 7" diameter, and a tire that is least 0.6" wide.

8. The elevator roller guide assembly of claim 7, wherein the side wheels are between 3" to 4" in diameter and the tires are at least 1.0" wide.

9. The elevator roller guide assembly of claim 8, having a ratio of wheel diameter sizes of the face wheel to the side wheels that is between 1:1 and 4:1.

10. The elevator roller guide assembly of claim 9, wherein the face wheel is about 6.6" and the side wheels are about 3.3".

11. The elevator roller guide assembly of claim 7, wherein the face wheel and side wheel tires each have a durometer hardness of between 80 A to 100 A.

12. The elevator roller guide assembly of claim 7, wherein tread contact covers enclose the face wheel and the side wheels.

13. The elevator roller guide assembly of claim 12, wherein the wheel force gauge comprises an indicator arm attached to the face wheel enclosure, indicating face wheel and side wheel loading.

14. The elevator roller guide assembly of claim 1, which provides a no-flat tire system, comprising several of the following: delta diameter wheels across all four roller guides having different diameters, tires having a durometer hardness of between 80 A to 100 A, a multi-axis damper, a wheel force gage, a complete wheel enclosure, or a self-aligning face wheel.

15. The elevator roller guide assembly of claim 1, wherein the multi-axis damper comprises a button shaped friction material set into an elastomeric mount, simultaneously dampens face and side wheel oscillations.

16. The elevator roller guide assembly of claim 1, which includes the mounting system of holes that allows bolt patterns of car or counter weight to be accommodated.

17. The elevator roller guide assembly of claim 1, which includes the wheel force gauge that is integrated with the face wheel enclosure, indicating face and side wheel loading.

18. The elevator roller guide assembly of claim 1, which includes each wheel having a slightly different diameter on the order of no more than 0.5" from the other wheels.

* * * * *